US010281138B2

(12) United States Patent
Mahoney

(10) Patent No.: US 10,281,138 B2
(45) Date of Patent: May 7, 2019

(54) ELECTRODE WATER HEATER

(71) Applicant: 3278470 NOVA SCOTIA LIMITED, Halifax, Nova Scotia (CA)

(72) Inventor: Jeff Mahoney, Halifax (CA)

(73) Assignee: 3278470 NOVA SCOTIA LIMITED, Nova Scotia (CA)

( * ) Notice: Subject to any disclaimer, the term of this patent is extended or adjusted under 35 U.S.C. 154(b) by 185 days.

(21) Appl. No.: 15/320,554

(22) PCT Filed: Jun. 18, 2015

(86) PCT No.: PCT/CA2015/000409
§ 371 (c)(1),
(2) Date: Dec. 20, 2016

(87) PCT Pub. No.: WO2015/192221
PCT Pub. Date: Dec. 23, 2015

(65) Prior Publication Data

US 2017/0153022 A1 Jun. 1, 2017

(30) Foreign Application Priority Data

Jun. 20, 2014 (CA) ..... 2854818

(51) Int. Cl.
*H05B 3/60* (2006.01)
*F22B 1/30* (2006.01)
(Continued)

(52) U.S. Cl.
CPC ..... *F22B 1/30* (2013.01); *F24H 1/10* (2013.01); *F24H 1/203* (2013.01)

(58) Field of Classification Search
CPC .. F24H 1/10; F24H 1/101–1/106; F24H 1/20; F24H 1/201–1/203; F22B 1/28; F22B 1/303; F22B 1/306; F22B 1/30
(Continued)

(56) References Cited

U.S. PATENT DOCUMENTS 2,404,336 A * 7/1946 Wicks ..... F24H 1/106 392/314
2,783,355 A * 2/1957 Vassiliev ..... F24H 1/106 392/315
(Continued)

FOREIGN PATENT DOCUMENTS

EP 2527497 A1 11/2012

OTHER PUBLICATIONS

PCT, International Search Report, International Application No. PCT/CA2015/000409, dated Sep. 24, 2015.
(Continued)

*Primary Examiner* — Sang Y Paik
(74) *Attorney, Agent, or Firm* — Thompson Hine LLP

(57) ABSTRACT

An electrode water heater/steam generator is provided. The electrode water heater/steam generator comprises a housing for containing water therein. The housing has at least an opening for transmission of water therethrough. At least two electrodes are disposed inside the housing and secured thereto such that at least one of the electrodes is enabled to vibrate during provision of AC electrical power. Electrical circuitry connects at least one of the electrodes to a live wire of an AC electrical power supply and at least another of the electrodes to a neutral wire of the AC electrical power supply.

14 Claims, 9 Drawing Sheets

(51) Int. Cl.
*F24H 1/10* (2006.01)
*F24H 1/20* (2006.01)

(58) Field of Classification Search
USPC ..... 392/311–38, 441, 444–451, 311–338
See application file for complete search history.

(56) References Cited

U.S. PATENT DOCUMENTS

| | | | | |
|---|---|---|---|---|
| 4,036,716 | A * | 7/1977 | Hulthe | C02F 1/46104 205/729 |
| 4,338,510 | A | 7/1982 | Chihara et al. | |
| 5,222,185 | A | 6/1993 | McCord, Jr. | |
| 7,742,689 | B2 * | 6/2010 | Harrison | A47J 27/21025 392/314 |
| 2006/0204231 | A1 | 9/2006 | Choi et al. | |

OTHER PUBLICATIONS

PCT, Written Opinion of the International Searching Authority, International Application No. PCT/CA2015/000409, dated Sep. 24, 2015.

* cited by examiner

ELECTRODE WATER HEATER

The present invention relates to electric water heaters and steam generators, and more particularly to an electrode water heater/electrode steam generator that provides hot water or steam at a substantially high speed and efficiency.

BACKGROUND

The most common form of electric hot water heating systems involves a storage tank in which water is heated to a predetermined temperature. The water in the storage tank is maintained at the predetermined temperature as water is drawn from the storage tank and replenished with cold inlet water. Electric hot water storage systems are generally considered to be energy inefficient as they operate on the principle of storing the water heated to a predetermined temperature greater than the temperature required for usage, even though the consumer may not require hot water until some future time. As thermal energy is lost from the hot water in the storage tank, further consumption of electrical energy is required to reheat that water to the predetermined temperature.

A more energy efficient means of heating water than storage tank systems involves the use of a tankless water heater system—also referred to as "on-demand" or "instant" water heater system—that heats water only when hot water is being used. Most prior art tankless water heater systems use resistance type electrical heating elements to heat the water. A major disadvantage of tankless water heater systems utilizing resistance type electric heating elements is that the elements themselves have substantial thermal mass and thermal resistance, substantially reducing the speed the water is heated, especially when the water flow is started from zero.

The alternative to using heating elements for heating the water is to pass an electrical current through the water by passing it between two electrodes between which an AC voltage exists, known as Direct Electrical Resistance (DER) heating. Unfortunately, existing electrode water heaters are highly complex, rendering them expensive to manufacture and difficult to implement in a compact fashion.

It is desirable to provide an electrode water heater/electrode steam generator that is simple and implementable in a compact fashion.

It is also desirable to provide an electrode water heater/electrode steam generator that provides hot water/steam at a substantially high speed and efficiency.

It is also desirable to provide an electrode water heater that provides boiling water at a substantially high speed and efficiency.

SUMMARY

Accordingly, one object of the present invention is to provide an electrode water heater/electrode steam generator that is simple and implementable in a compact fashion.

Another object of the present invention is to provide an electrode water heater/electrode steam generator that provides hot water/steam at a substantially high speed and efficiency.

Another object of the present invention is to provide an electrode water heater that provides boiling water at a substantially high speed and efficiency.

According to one aspect of the present invention, there is provided an electrode water heater. The electrode water heater comprises a housing for containing water therein. The housing has at least an opening for transmission of water therethrough. At least two electrodes are disposed inside the housing and secured thereto such that at least one of the electrodes is enabled to vibrate during provision of AC electrical power. Electrical circuitry connects at least one of the electrodes to a live wire of an AC electrical power supply and at least another of the electrodes to a neutral wire of the AC electrical power supply.

According to one aspect of the present invention, there is provided an electrode water heater.

The electrode water heater comprises a housing for containing water therein. The housing has at least an opening for transmission of water therethrough. At least two electrodes are disposed inside the housing and secured thereto such that at least one of the electrodes is enabled to vibrate during provision of AC electrical power. The electrodes comprise an inner electrode having a longitudinal axis and at least one hollow cylinder placed concentric thereto.

According to one aspect of the present invention, there is provided an electrode water heater. The electrode water heater comprises a housing for containing water therein. The housing has at least an opening for transmission of water therethrough. At least two electrodes are disposed inside the housing and secured thereto such that at least one of the electrodes is enabled to vibrate during provision of AC electrical power. Electrical circuitry connects each of the electrodes to a live wire of a multiphase AC electrical power supply.

One advantage of the present invention is that it provides an electrode water heater/electrode steam generator that is simple and implementable in a compact fashion.

A further advantage of the present invention is that it provides an electrode water heater/electrode steam generator that provides hot water/steam at a substantially high speed and efficiency.

A further advantage of the present invention is to provide an electrode water heater that provides boiling water at a substantially high speed and efficiency.

BRIEF DESCRIPTION OF THE DRAWINGS

One embodiment of the present invention is described below with reference to the accompanying drawings, in which.

DETAILED DESCRIPTION

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, certain methods and materials are now described.

While the description of the embodiments hereinbelow is with reference to an instant water boiler for providing relatively small quantities of hot/boiling water/steam for human consumption in a residential household setting, it will become evident to those skilled in the art that the embodiments of the invention are not limited thereto, but are also adaptable for providing larger quantities of hot/boiling water/steam in various other applications such as, for example, heating and industrial processes.

Figure 1A:
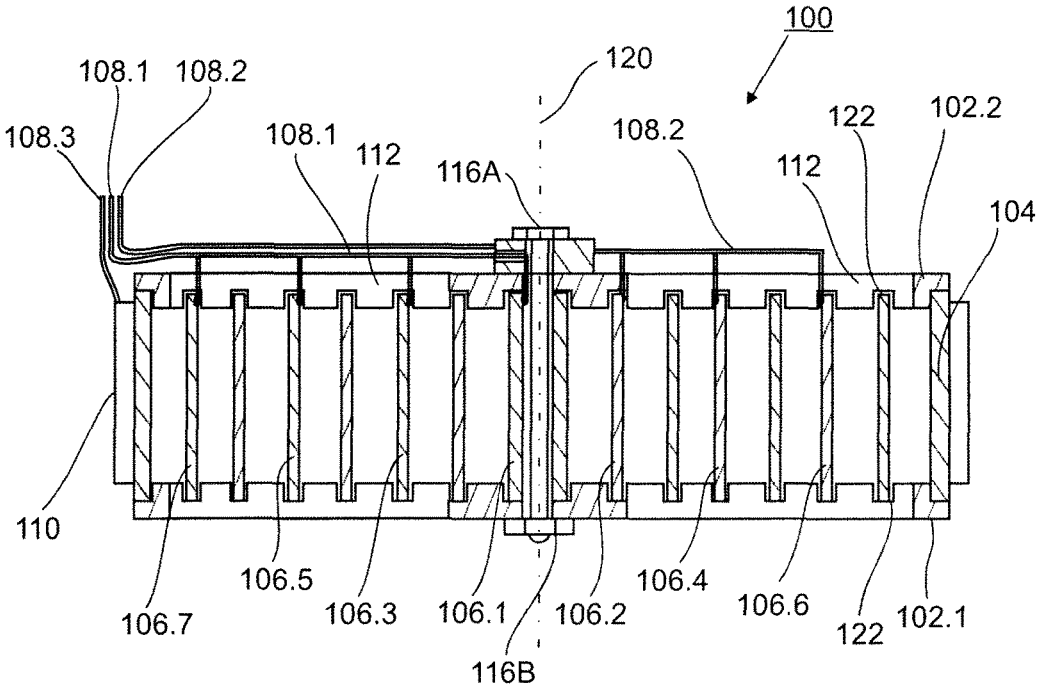
FIG. 1*a* is a simplified block diagram illustrating a cross sectional view of an electrode water heater according to an embodiment of the invention.
Figure 1B:
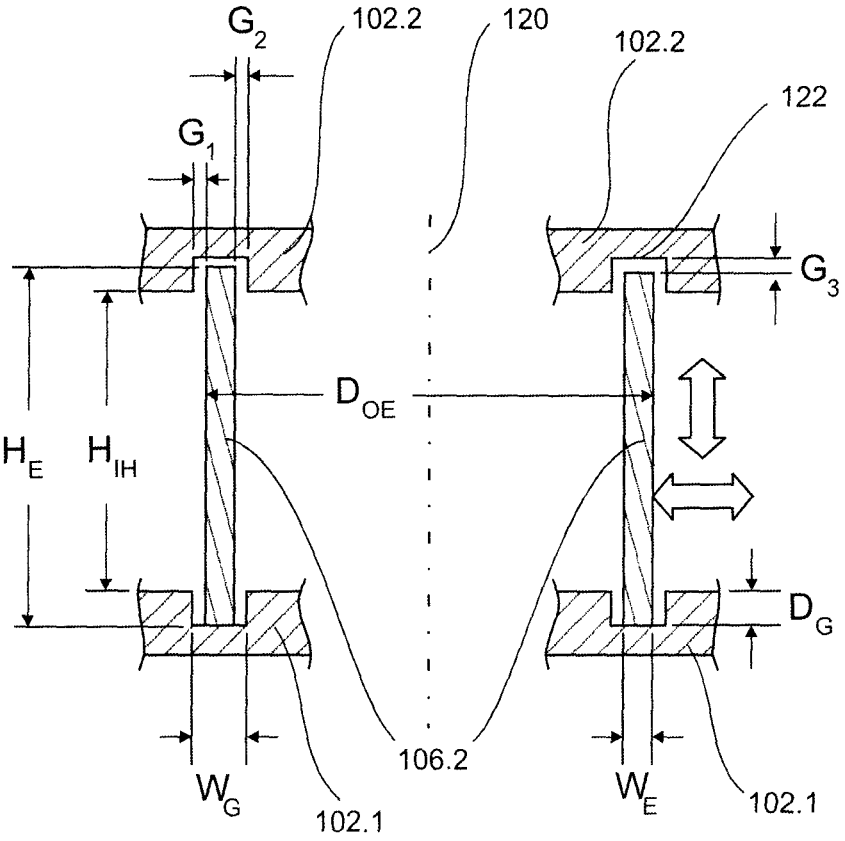
FIG. 1*b* is a simplified block diagram illustrating in a detailed cross sectional view one electrode placed in a housing of the electrode water heater according to an embodiment of the invention.
Figure 1C:
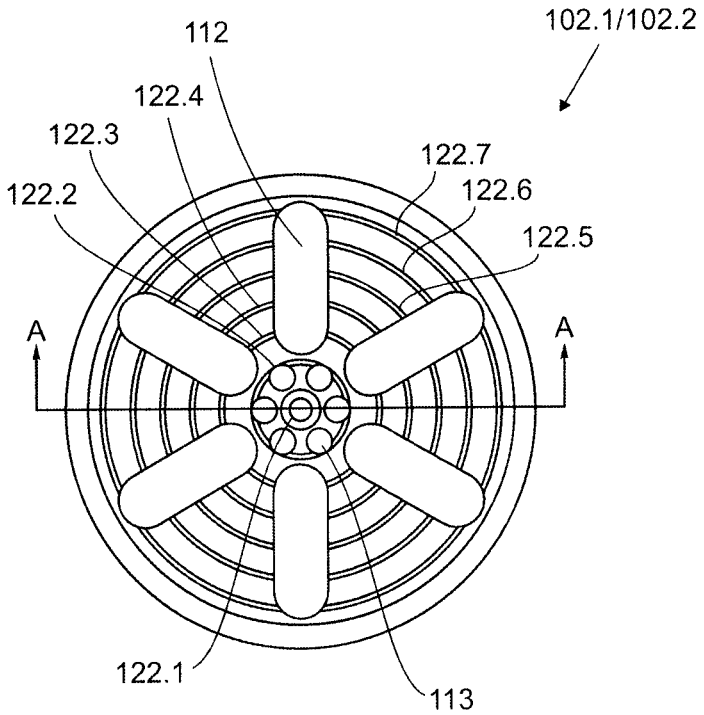
FIGS. 1*c* to 1*g* are simplified block diagrams illustrating a top view, a cross sectional view, a side view, a perspective top view, and a perspective bottom view of the bottom plate of the electrode water heater according to an embodiment of the invention.
Figure 1D:
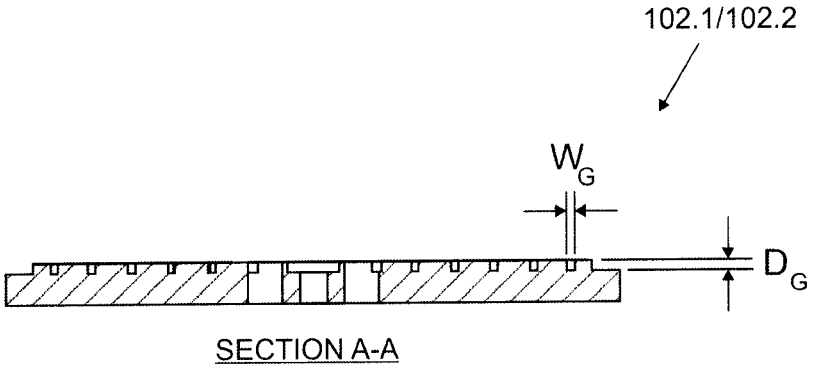
Figure 1E:
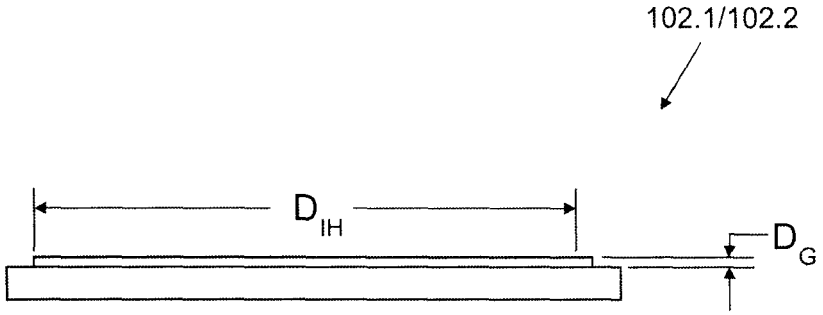
Figure 1F:
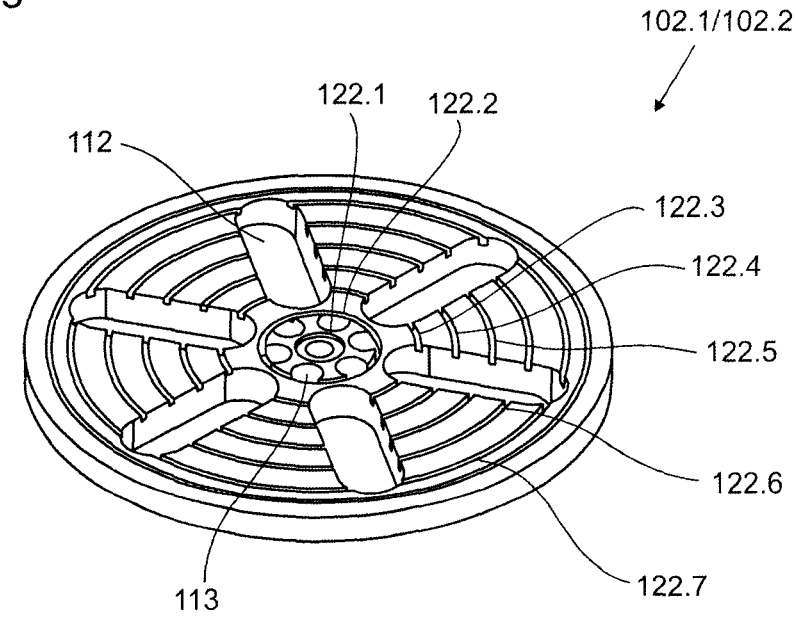
Figure 1G:
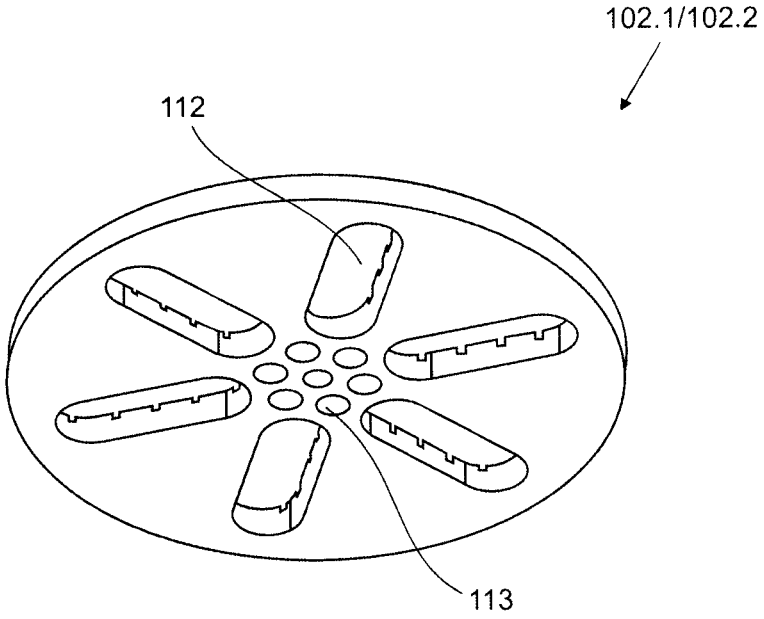

Referring to FIGS. 1*a* to 1*g*, an electrode water heater 100 according to an embodiment of the invention is provided. The electrode water heater 100 comprises an electrically non-conductive housing, in one case, having a bottom plate 102.1, a top plate 102.2, and a housing ring 104. The bottom plate 102.1, the top plate 102.2, and the housing ring 104 are made of a heat resistant and electrically non-conductive material, in one case, a plastic material such as, for example, Acetal using standard plastic molding techniques. Alternatively, other heat resistant and electrically non-conductive materials may be employed or the inside of the housing may be coated with a heat resistant and electrically non-conductive material. Electrodes 106.1-106.7 are disposed inside the housing with the electrodes 106.2-106.7 being provided as hollow cylinders surrounding inner electrode 106.1 concentrically about longitudinal axis 120, as illustrated in FIG. 1*a*. The electrodes 106.1-106.7 can be spaced equidistant apart. Upper and lower end portions of the electrodes 106.2-106.7 are accommodated in respective grooves 122 disposed in the bottom plate 102.1 and the top plate 102.2. The electrodes 106.2-106.7 and the grooves 122 are dimensioned such that the width $W_G$ of the grooves 122 is greater than the width $W_E$ of the electrodes 106.2-106.7, leaving gaps $G_1$ and $G_2$ therebetween, as well as the height $H_E$ of the electrodes 106.2-106.7, the inner height $R_H$ of the housing and the depth $D_G$ of the grooves 122 being such that there is gap $G_3$ between the top of the electrodes 106.2-106.7 and the respective grooves 122, as illustrated in FIG. 1*b*. Provision of the electrodes 106.2-106.7 and the grooves 122 as illustrated in FIG. 1*b* holds the electrodes 106.2-106.7 with respect to: each other having predetermined distances therebetween; the inner electrode 106.1; and, the housing, but also the enables the electrodes 106.2-106.7 to vibrate in a direction along the axis 120 as well as in directions perpendicular thereto within a predetermined range—gaps $G_1$, $G_2$, and $G_3$—as indicated by the block arrows in FIG. 1*b*. The electrodes 106.1-106.7 are made of an electrically conductive material such as, for example, aluminum, stainless steel, or brass. The housing, together with the electrodes 106, is secured using, for example, a screw bolt 116A in concert with screw nut 116B such that the inner electrode 106.1 and the housing ring 104 are abutted between the bottom plate 102.1 and the top plate 102.2, thus enabling simple assembly of the device. The housing ring 104, the bottom plate 102.1 and the top plate 102.2 can be in a watertight contact when secured. Optionally, a seal such as, for example, an O-ring, is disposed between the housing ring 104 and the respective housing plate 102.1/102.2. Further optionally, the electrode 106.1 is provided as a hollow cylinder having abutting cylinder disposed inside, enabling the electrode 106.1 to be disposed such that the same can vibrate.

The electrodes 106.1-106.7 are connected to insulated wiring 108.1 and 108.2 in an alternating fashion, as illustrated in FIG. 1*a*, with the wiring 108.1 and 108.2 for being connected to a neutral wire and a live wire, respectively, of single phase AC electrical power—also known as household power—or vice versa. The wiring 108.1 and 108.2 is provided using off-the-shelf insulated wiring for household power and is connected to the respective electrodes 106.1-106.7 using standard fitting technology such as, for example, soldering. The connection of the wiring with the electrodes can be coated in order to prevent contact of copper wiring and solder with the water when the same is used for human consumption. The wiring 108.1 and 108.2 is sufficiently flexible to enable the electrodes 106.2-106.7 to vibrate as described hereinabove. For protecting a user of the heater 100 against electrical shock in case of a malfunction of the device, grounding ring 110 for being connected to ground via wiring 108.3 is disposed around housing ring 104. Optionally, the grounding ring 110 is omitted, for example, when the heater 100 is disposed inside a grounded housing.

Water is provided to the electrodes 106.1-106.7 and removed therefrom after heating via apertures 112, 113 disposed in the top plate 102.2 and the bottom plate 102.1. The apertures 112, 113 can be placed such that the water is approximately equally distributed around the electrodes 106.1-106.7 and dimensioned to enable a water flow therethrough within a predetermined range. For example, in applications where the heater 100 is empty when not in use, the water flow is restricted to the extent such that a power surge is prevented when the heater 100 is started.

In operation AC current is passed through the water disposed between adjacent electrodes heating the same. A large electrode surface area in contact with the water can be disposed in a relatively small volume, for example, by providing a plurality of nested electrodes such as concentric ring electrodes, as illustrated in FIG. 1*a*. The speed of heating the water is increased by enabling the electrodes to vibrate induced by the provision of the AC electrical power.

As is evident, the electrode water heater 100 is implementable employing different numbers of two or more electrodes. Furthermore, the electrodes may have other shapes than circular ring shape such as, for example, rings having oval or square cross sections, plates, half spheres.

The electrode water heater 100 is designed in dependence upon the electrical conductivity of the water, the range of the water flow rate, the range of desired hot water temperatures, and the electrical power (Voltage and frequency), using standard electrical engineering methods. The electrodes can be designed such that the electrical power drawn by the device does not exceed a predetermined limit.

It is noted that, while the electrode water heater 100 is described with its longitudinal axis 120 oriented substantially vertical, the same is also operable with the longitudinal axis 120 oriented substantially horizontal or at angles therebetween.

Figure 2A:
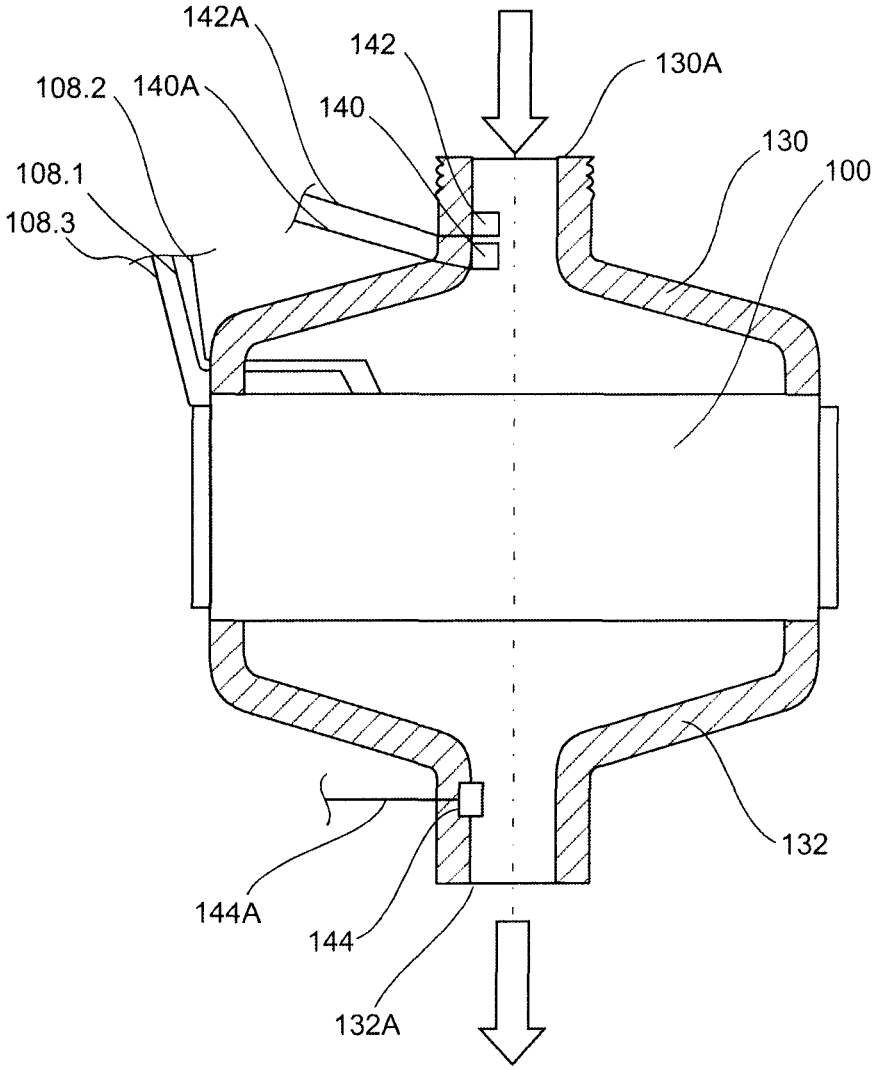
FIG. 2*a* is a simplified block diagram illustrating a cross sectional view of the electrode water heater according to an embodiment of the invention with water inlet and water outlet mounted thereto.
Figure 2B:
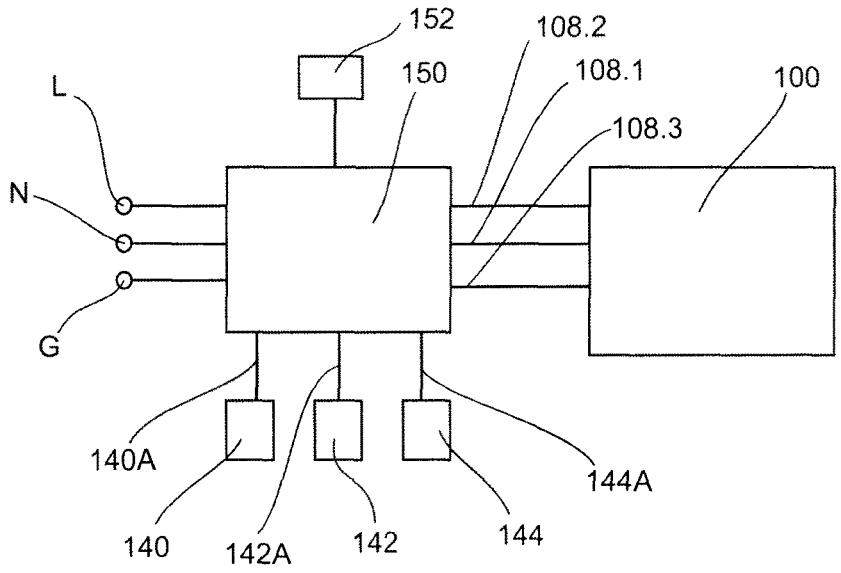
FIG. 2*b* is a simplified block diagram illustrating control circuitry for operating the electrode water heater according to an embodiment of the invention.
Figure 2C:
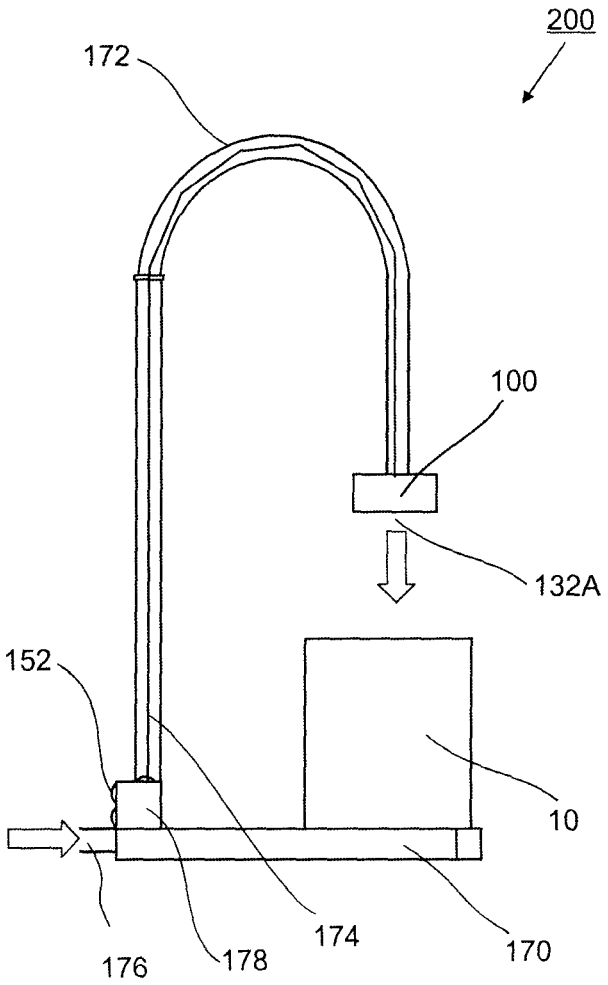
FIG. 2*c* is a simplified block diagram illustrating a side view of an instant water heater employing the electrode water heater according to an embodiment of the invention; and, FIG. 3 is a simplified block diagram illustrating a cross sectional view of a boiler type water heater employing the electrode water heater according to an embodiment of the invention.

Referring to FIGS. 2*a* to 2*c*, the electrode water heater 100 has been implemented in an instant water heater 200, illustrated in FIG. 2*c*, for providing a relatively small quantity of hot/boiling water in a kitchen, replacing an electric kettle. The electrode water heater 100 has mounted thereto water inlet 130 for receiving water through inlet opening 130A and water outlet 132 for providing the heated/boiling water through outlet opening 132A, as indicated by the block arrows in FIG. 2*a*. The water inlet 130 and the water outlet 132 are made of a heat resistant and electrically non-conductive material, in one case, a plastic material such as, for example, Acetal using standard plastic molding techniques. The water inlet 130 and the water outlet 132 are, for example, mounted to the top plate 102.2 and the bottom plate 102.1, respectively, of the electrode water heater 100 in a water tight fashion using, for example, an adhesive. Inlet temperature sensor 140 and water flow sensor 142 can be disposed in the inlet 130 for sensing the inlet water temperature and the inlet water flow rate and for providing signals indicative thereof via wiring 140A and 142A, as well as outlet water temperature sensor 144 disposed in the water outlet 132 for sensing the outlet water temperature and for providing a signal indicative thereof via wiring 144A.

Referring to FIG. 2*b*, control circuitry 150 is connected to a single phase AC electrical power source—for example, 120V and 60 Hz (North America)—via a plug mated with a standard household power outlet. The control circuitry 150 is connected: to the electrode water heater 100 via wiring 108.1, 108.2, 108.3 for providing electrical power thereto in a controlled fashion; the sensors 140, 142, and 144 via respective wiring 140A, 142A, and 144A for receiving sensor signals; and to user interface 152 for receiving user input data such as a desired water temperature. For example, the control circuitry 150 comprises a microprocessor for receiving the user input data and the sensor data and for controlling the provision of the electrical power to the electrode water heater 100 in dependence upon the user input data and the sensor data.

Alternatively, the user interface 152 and the sensors 140, 142, and 144 are omitted and the control circuitry 150 is employed for limiting the supply of electrical power to the electrode heater 100, for example, to 1200 W, in order to prevent a power surge.

The instant water heater 200 comprises a base plate 170 having mounted thereto a curved tube 172 made of, for example, stainless steel. A bottom end of the tube 172 comprises inlet 176 for being connected to a water supply for receiving water therefrom. A top end of the tube 172 is mounted to the electrode water heater 100 via water inlet 130. Control housing 178 comprises the control circuitry 150 connected to the electrode water heater 100 via cable 174—containing the wiring 108.1, 108.2, 108.3, 140A, 142A, and 144A—and user interface 152. The control housing can also comprise a solenoid valve for regulating the water flow through the tube 172 in dependence upon user input received via the user interface 152. The user interface comprises, for example, conventional knobs that are turned for determining the water flow and the temperature or push buttons. In operation, water is received at the inlet 176 and provided to the electrode water heater via tube 172 and provided therefrom after heating via water outlet 132A, as indicated by the block arrows in FIG. 2*c*, into a receptacle 10 such as, for example, a pot or mug, placed onto the base plate 170.

The electrodes 106.1-106.7 of the electrode water heater 100 as employed in the instant water heater 200 are made of aluminum having the dimensions of: height $H_E$ of 1.39"; width $W_E$ of 0.031"; and outside diameters $D_{OE}$ in ascending order of 0.375", 0.938", 1.5"; 2.063", 2.625", 3.188", and 3.75". The housing is made of Acetal having the inside dimensions of: height $H_{IH}$ of 1.27" and diameter $D_{IH}$ of 4.00". The grooves 122 have the dimensions of: depth $D_G$ of 0.065" and width of $W_G$ of 0.055".

Figure 3:
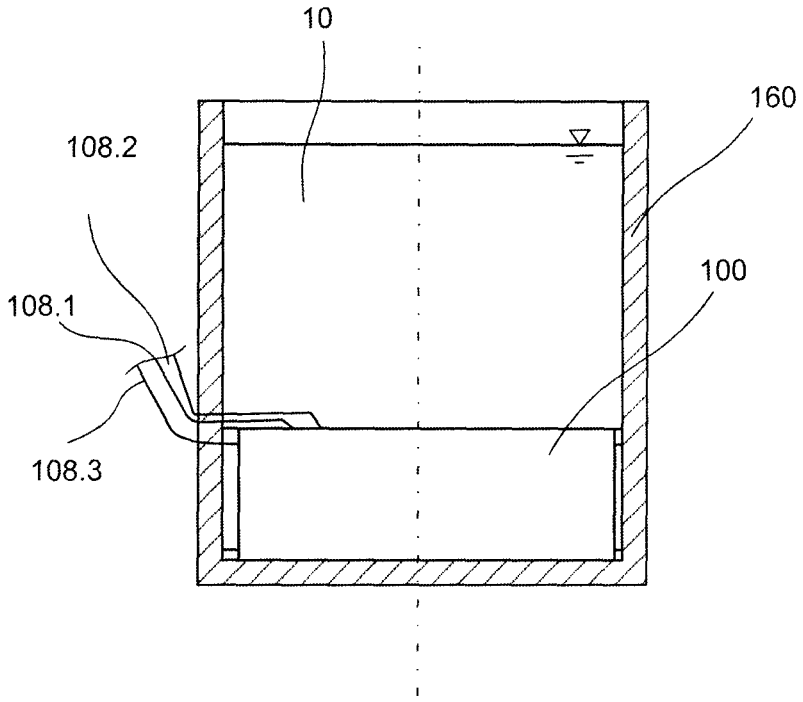

Alternatively, the electrode water heater 100 is employed in a boiler type water heater such as, for example, a kettle, as illustrated in FIG. 3. Here, the electrode water heater 100 is disposed in the bottom of receptacle 160 containing water 10, replacing the resistance type electrical heating elements of a conventional kettle.

Further alternatively, the electrode water heater 100 is implemented for producing steam, for example, by providing a reduced amount of water such that only a bottom portion of the electrodes 106 is submerged in the water. Optionally, an electrolyte such as, for example, baking soda, is added to the water to increase the efficiency of the steam production.

Further alternatively, the electrode water heater 100 is adapted for being connected to multiphase AC electrical power. For example, the electrode water heater 100 is provided with three electrodes 106 with each electrode being connected to a live wire associated with one phase of three phase AC electrical power. In particular for generating steam, high frequency and high voltage can be used, for example, a frequency of 400 Hz and each phase having a voltage of 200V.

The present invention has been described herein with regard to certain embodiments. However, it will be obvious to persons skilled in the art that a number of variations and modifications can be made without departing from the scope of the invention as described herein.

What is claimed is:

1. An electrode water heater comprising:

a housing for containing water therein, the housing having at least an opening for transmission of water therethrough;

at least two electrodes disposed inside the housing and secured thereto, wherein a first and a second end portion of at least one of the electrodes are secured to the housing such that the at least one electrode is movable with respect to the housing in a direction of a longitudinal axis of the at least one electrode and in directions perpendicular thereto to enable the same to vibrate during provision of AC electrical power; and, electrical circuitry connected to the electrodes, the electrical circuitry for connecting at least one of the electrodes to a live wire of an AC electrical power supply and at least another of the electrodes to a neutral wire of the AC electrical power supply.

2. The electrode water heater according to claim 1 wherein the electrodes are disposed in a nested fashion.

3. The electrode water heater according to claim 2 wherein the electrodes are connected to the live wire and the neutral wire in an alternating fashion.

4. The electrode water heater according to claim 3 wherein the number of electrodes is greater than two.

5. The electrode water heater according to claim 4 wherein the number of electrodes is an odd number.

6. The electrode water heater according to claim 3 wherein the electrodes comprise an inner electrode having a longitudinal axis and at least one hollow cylinder placed concentric thereto.

7. The electrode water heater according to claim 6 wherein the inner electrode is fixedly mounted to the housing and the at least one hollow cylinder is enabled to vibrate.

8. The electrode water heater according to claim 6 wherein the inner electrode and the hollow cylinder have a circular cross section.

9. The electrode water heater according to claim 8 wherein in operation the longitudinal axis is oriented substantially vertically.

10. The electrode water heater according to claim 9 wherein a first opening is placed in a top end of the housing and a second opening is placed in a bottom end of the housing.

11. The electrode water heater according to claim 1 wherein the electrodes are placed between a first end and a second end of the housing and wherein a first opening is placed in the first end for provision of water and a second opening is placed in the second end for removal of water after heating.

12. The electrode water heater according to claim 1 wherein the first and the second end portion of the at least one electrode are accommodated in respective grooves disposed in the housing and wherein the grooves have a predetermined width and a predetermined depth such that there are gaps between the at least one electrode and the housing in a direction of the longitudinal axis and in directions perpendicular thereto.

13. An electrode water heater comprising:

a housing for containing water therein, the housing having at least an opening for transmission of water therethrough;

at least two electrodes disposed inside the housing and secured thereto, wherein a first and a second end portion of at least one of the electrodes are secured to the housing such that the at least one electrode is movable with respect to the housing in a direction of a longitudinal axis of the at least one electrode and in directions perpendicular thereto to enable the same to vibrate during provision of AC electrical power; and, electrical circuitry connected to the electrodes, the electrical circuitry for connecting each of the electrodes to a live wire of a multiphase AC electrical power supply.

14. The electrode water heater according to claim 13 wherein the first and the second end portion of the at least one electrode are accommodated in respective grooves disposed in the housing and wherein the grooves have a predetermined width and a predetermined depth such that there are gaps between the at least one electrode and the housing in a direction of the longitudinal axis and in directions perpendicular thereto.

* * * * *